US009165514B2

(12) United States Patent
Choi et al.

(10) Patent No.: US 9,165,514 B2
(45) Date of Patent: Oct. 20, 2015

(54) DISPLAY APPARATUS AND BACKLIGHT UNIT

(75) Inventors: Sung-jin Choi, Gunpo-si (KR); Sang-hoon Lee, Suwon-si (KR); Tae-hoon Kim, Suwon-si (KR); Pankaj Agarwal, Suwon-si (KR); Myoung-jun Lee, Bucheon-si (KR); Youn-hee Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 844 days.

(21) Appl. No.: 12/838,666

(22) Filed: Jul. 19, 2010

(65) Prior Publication Data

US 2011/0122169 A1 May 26, 2011

(30) Foreign Application Priority Data

Nov. 24, 2009 (KR) ..... 10-2009-0113874

(51) Int. Cl.
*G09G 3/34* (2006.01)
*H05B 33/08* (2006.01)

(52) U.S. Cl.
CPC ..... *G09G 3/342* (2013.01); *H05B 33/0827* (2013.01); *H05B 33/0857* (2013.01); *G09G 2310/0235* (2013.01); *G09G 2320/0233* (2013.01); *G09G 2320/064* (2013.01); *G09G 2320/0666* (2013.01); *G09G 2330/02* (2013.01); *G09G 2330/028* (2013.01)

(58) Field of Classification Search
CPC ..... G06G 3/342; G06G 2320/0233; G06G 2320/064; G06G 2310/0235; G06G 2320/0666; G06G 2330/02; G06G 2330/028; H05N 33/0827; H05N 33/0857
USPC ..... 345/102, 212; 315/295, 297
See application file for complete search history.

(56) References Cited

U.S. PATENT DOCUMENTS

| | | | | |
|---|---|---|---|---|
| 7,919,936 | B2 * | 4/2011 | Liu et al. | 315/307 |
| 2006/0152468 | A1 * | 7/2006 | Ozaki | 345/102 |
| 2007/0115228 | A1 * | 5/2007 | Roberts et al. | 345/82 |
| 2010/0264847 | A1 * | 10/2010 | Chen et al. | 315/295 |

FOREIGN PATENT DOCUMENTS

| | | | |
|---|---|---|---|
| KR | 10-2007-0089454 | A | 8/2007 |
| KR | 10-2009-0076330 | A | 7/2009 |
| WO | 2008110990 | A1 | 9/2008 |

OTHER PUBLICATIONS

Communication, Issued by the European Patent Office, Dated Oct. 16, 2014, in counterpart European Application No. 10190703.8.

* cited by examiner

*Primary Examiner* — Allison Johnson
(74) *Attorney, Agent, or Firm* — Sughrue Mion, PLLC

(57) ABSTRACT

A display apparatus is provided. The display apparatus includes: a display panel; and a backlight unit which provides the display panel with backlight. The backlight unit includes: a converter which converts a voltage of a received power and outputs an output power, a plurality of light source modules which receives the output power from the converter, and a control unit which determines powering conditions to operate the plurality of the light source modules in a specific state for each of the plurality of light source modules, and controls the converter sequentially based on the determined powering conditions.

22 Claims, 6 Drawing Sheets

DISPLAY APPARATUS AND BACKLIGHT UNIT

CROSS-REFERENCE TO RELATED APPLICATION

This application claims priority from Korean Patent Application No. 10-2009-0113874, filed Nov. 24, 2009, in the Korean Intellectual Property Office, the disclosure of which is incorporated herein by reference in its entirety.

BACKGROUND

1. Field

Apparatuses and methods consistent with exemplary embodiments relate to a display apparatus and a backlight unit (BLU), and more particularly, to a display apparatus which provides backlight using a plurality of light source modules, and a BLU.

2. Description of the Related Art

As multimedia devices such as televisions (TVs), mobile phones, and laptops have developed, there has been an increasing demand for the technical development of the flat panel display devices in association with display apparatuses. The flat panel display devices may include plasma display panel (PDP), liquid crystal display (LCD), field emission display (FED), and vacuum fluorescent display (VFD).

Recently, LCDs have become popular, particularly due to advanced production technology, efficient driving, and the high resolution. LCDs change electronic data output from a plurality of devices into visible data using variations in light permeability of the liquid crystal according to the applied voltages.

Since an LCD displays a desired image on a screen by adjusting an amount of light passing through the liquid crystal layer based on the index of refractive anisotropy, it is necessary that a BLU is installed as a light source to emit light through the liquid crystal layer.

The BLU generally includes light sources to generate backlight, and driving elements to drive the light sources. The light sources are arranged to emit the backlight onto the LCD, and include an appropriate number of driving elements for an efficient driving of the light sources.

The cold cathode fluorescent lamp (CCFL), light emitting diode (LED), or electroluminescent (EL) light may be used as light sources for the BLU. Lately, the LED became popular choice to replace the CCFL, as the LED provides higher level of brightness, longer lifespan, and better thermal characteristic. Therefore, BLUs with a plurality of LED aligning structures are used in a wider range of applications due to the longer lifespan and higher efficiency of the LEDs as compared to some other light sources.

However, the BLUs including LEDs may have some drawbacks. For example, the imbalance of brightness may occur due to variations of forward voltages in the factory or variations of driving during circuit arrangement. It may be possible to control the stability of the light source modules by adding converters for each of the light source modules. However, such solution may result in complicated circuits and increased cost.

SUMMARY

Exemplary embodiments address at least the above problems and/or disadvantages and other disadvantages not described above. Also, an exemplary embodiment is not required to overcome the disadvantages described above, and an exemplary embodiment may not overcome any of the problems described above.

Exemplary embodiments provide a display apparatus and a BLU capable of correcting brightness imbalance of a plurality of light source modules.

More specifically, exemplary embodiments provide correcting brightness imbalance of a plurality of light source modules by determining optimum powering condition for each of the light source modules to operate the light source modules with the constant brightness, and controlling a converter in accordance with the determined powering condition.

According to another aspect of exemplary embodiments, there is provided a display apparatus and a BLU which provide a simpler driving circuit, lower power consumption and reduced cost.

According to an aspect of an exemplary embodiment, there is provided a display apparatus, which may include a display panel, and a BLU which provides the display panel with backlight. The BLU may include a converter which converts a voltage of a received power and outputs the result, a plurality of light source modules which receive a power output from the converter, and a control unit which determines powering conditions to operate the plurality of the light source modules in a specific state in relation to each of the light source modules, and controls the converter sequentially based on the determined powering conditions.

The display apparatus may further include a switching unit which applies a power output from the converter to one of the plurality of light source module. The control unit may control the switching unit to apply the power output from the converter to the plurality of light source modules sequentially, and controls the converter based on the powering conditions sequentially.

The control unit may determine the powering conditions for each of the plurality of light source modules sequentially, in the manner of determining a powering condition relative to the light source module which currently receives the power through the switching unit.

The control unit may sense a voltage applied to the light source module which currently receives the power, before the light source module currently receiving the power is switched off and the light source module in the next order is switched on, and determine the powering conditions based on the sensed voltage.

The BLU may further include a memory which stores the powering conditions. The control unit may store the determined powering conditions sequentially in the memory, and control the converter sequentially by referring to the stored powering conditions sequentially.

The plurality of light source modules may include a first light source module and a second light source module. The control unit may control the converter according to a first powering condition which is determined relative to the first light source module, for the duration in which the power output from the converter is applied to the first light source module, and control the converter according to a second powering condition which is determined relative to the second light source module, for the duration in which the power output from the converter is applied to the second light source module.

The display apparatus may further include a switching unit which operates to apply the power output from the converter sequentially to the second light source module, after the power is applied to the first power source module, and the control unit may sense the voltage applied to the first light source module before the first light source module is switched off and the second light source module is switched on, and determine the powering condition based on the sensed voltage.

The control unit may control the converter based on a previously-determined powering condition, if the first light source module is switched on again, so that a corrected voltage is applied to the first light source module.

The memory may be a first-in-first-out (FIFO) memory, which stores the powering conditions sequentially and refers the stored powering conditions sequentially.

The specific state may be the state in which a constant brightness is output from the plurality of light source modules.

The powering conditions may include duty ratios applied to the converter to operate the plurality of light source modules in the specific state.

According to an aspect of another exemplary embodiment, there is provided a BLU, which may include a converter which converts a voltage of an input power and outputs the converted result, a plurality of light source modules which receive the power output from the converter, and a control unit which determines powering conditions to operate the plurality of light source modules in a specific state, relative to each of the light source modules, and controls the converter sequentially in accordance with the determined powering conditions.

The BLU may further include a switching unit which applies a power output from the converter to one of the plurality of light source module, and the control unit may control the switching unit to apply the power output from the converter to the plurality of light source modules sequentially, and control the converter based on the powering conditions sequentially.

The control unit may determine the powering conditions for each of the plurality of light source modules sequentially, in the manner of determining a powering condition relative to the light source module which currently receives the power through the switching unit.

The control unit may sense a voltage applied to the light source module which currently receives the power, before the light source module currently receiving the power is switched off and the light source module in the next order is switched on, and determine the powering conditions based on the sensed voltage.

The BLU may further include a memory which stores the powering conditions, and the control unit may store the determined powering conditions sequentially in the memory, and control the converter sequentially by referring to the stored powering conditions sequentially.

The plurality of light source modules may include a first light source module and a second light source module, and the control unit may control the converter according to a first powering condition which is determined relative to the first light source module, for the duration in which the power output from the converter is applied to the first light source module, and control the converter according to a second powering condition which is determined relative to the second light source module, for the duration in which the power output from the converter is applied to the second light source module.

The BLU may further include a switching unit which operates to apply the power output from the converter sequentially to the second light source module, after the power is applied to the first power source module, and the control unit may sense the voltage applied to the first light source module before the first light source module is switched off and the second light source module is switched on, and determine the powering condition based on the sensed voltage.

The control unit may control the converter based on a previously-determined powering condition, if the first light source module is switched on again, so that a corrected voltage is applied to the first light source module.

The specific state may be the state in which a constant brightness is output from the plurality of light source modules.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
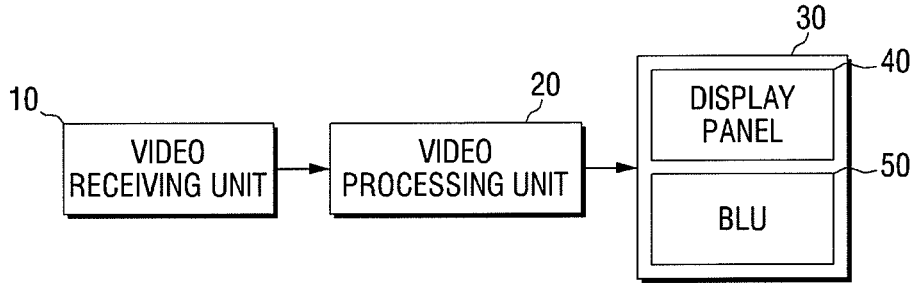
FIG. 1 is a block diagram of a display apparatus according to an exemplary embodiment.

Certain exemplary embodiments are described in greater detail below with reference to the accompanying drawings.

In the following description, like drawing reference numerals are used for the like elements, even in different drawings. The matters defined in the description, such as detailed construction and elements, are provided to assist in a comprehensive understanding of an exemplary embodiment. However, exemplary embodiments can be practiced without those specifically defined matters.

FIG. 1 illustrates the structure of a display apparatus according to an exemplary embodiment.

Referring to FIG. 1, the display apparatus may include a video receiving unit 10, a video processing unit 20, and a display module 30. The display module 30 may include a display panel 40, and a BLU 50.

The video receiving unit 10 may receive a video signal from an external source, as for example, via wireless video reception over the air or through the cable, or a wired video reception through the DVD player or settop box.

The video processing unit 20 may carry out signal processing such as video decoding, video scaling, or frame rate conversion.

The display module 30 may display a signal output from the video processing unit 20. The display panel 40 of the display module 30 may display video content which is signal-processed by the video processing unit 20. The BLU 50 may emit backlight onto the display panel 40 so that a user may view the video on the display panel 40.

Figure 2:
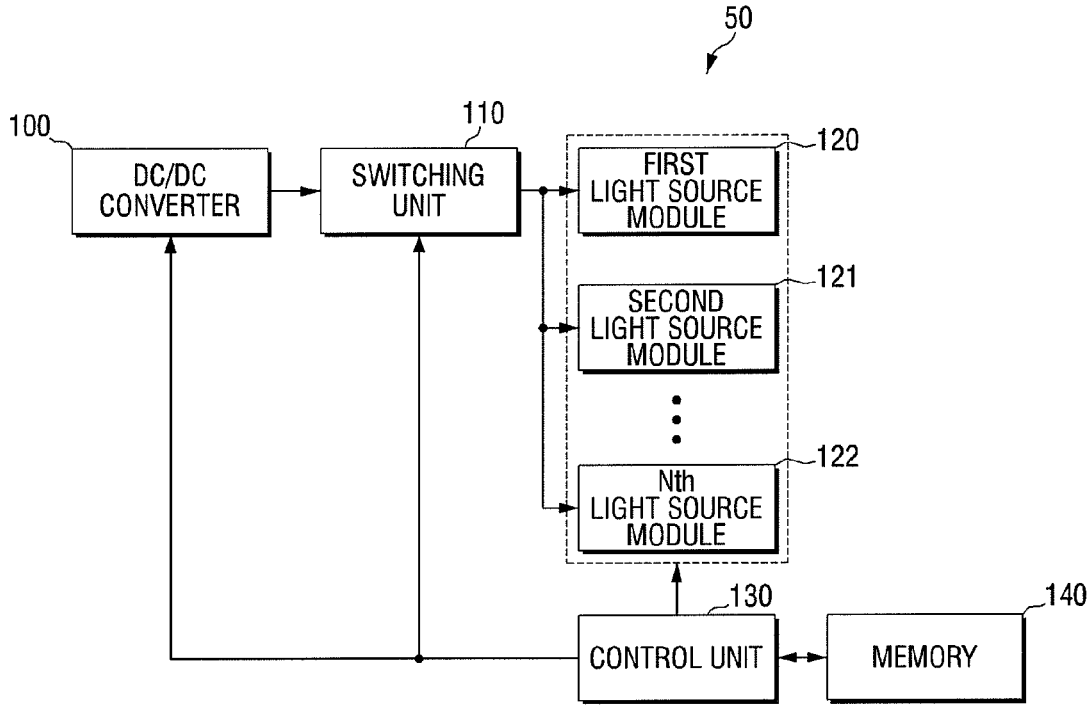
FIG. 2 is a block diagram of a BLU according to an exemplary embodiment.

FIG. 2 is a block diagram of a BLU according to an exemplary embodiment.

Referring to FIG. 2, the BLU 50 may include a DC/DC converter 100, a switching unit 110, a plurality of light source modules 120, 121, 122, a control unit 130, and a memory 140.

The DC/DC converter 100 may convert a voltage input from a power source, and supply the converted voltage to the plurality of light source modules 120, 121, 122. Herein, the DC/DC converter is an example provided for convenient explanation, but should not be construed as limiting.

The switching unit 110 may operate to switch a power output from the DC/DC converter 100 so that the power is supplied to one of the plurality of light source modules 120, 121, 122. The switching unit 110 may carry out a switching operation to determine a powering condition of the light source modules 120, 121, 122, under the control of the control unit 130.

The powering condition may be a duty ratio which is applicable to the DC/DC converter 100 to drive the plurality of light source modules 120, 121, 122 with the constant brightness.

The plurality of light source modules may include a number N of light source modules 120, 121, 122 which each receives a voltage output from the DC/DC converter 100 via the switching unit 110, and provides the backlight. The light source modules 120, 121, 122 may include module type products such as LED strings in which LEDs are connected in series or in parallel, or a light bar.

The control unit 130 may control the switching unit 110 to determine the powering condition for each of the light source modules 120, 121, 122, and control the DC/DC converter 100 based on the determined powering condition to provide each of the light source modules 120, 121, 122 with the corresponding voltage. The control unit 130 may store the determined powering conditions in the memory 140 in sequence, or read out the stored powering conditions in sequence.

The memory 140 may store the determined powering conditions and refer to the stored powering conditions. Referring to the particular functions of the memory 140 described above, that is, referring to the function of storing the powering condition in sequence and reading out the stored powering condition for reference, a FIFO type memory may be used, but exemplary embodiments are not limited thereto.

The BLU according to an exemplary embodiment is described below with reference to FIGS. 3 and 4.

For example, the LED modules may be grouped into block units. Since the LED modules may be fabricated under the same fabricating process, and driven under the similar temperature condition as the LED modules are generally positioned adjacent to each other, the LED modules may have the similar forward voltages which are the minimum voltages to drive the LEDs. Accordingly, it is possible to drive a plurality of LED modules in block units.

Figure 4:
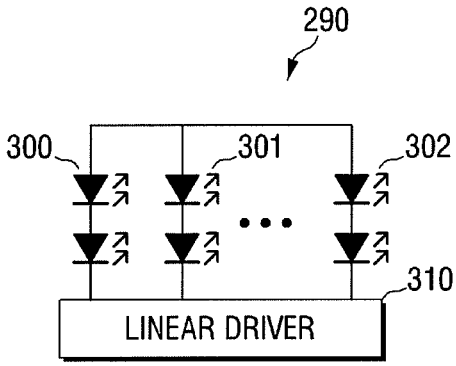
FIG. 4 is a view illustrating the structure of an LED module according to an exemplary embodiment.

FIG. 4 illustrates the structure of an LED module according to an exemplary embodiment. The LED module 290 may include a plurality of LEDs or LED strings 300, 301, 302, and be connected to a linear driver 310 for the current drive of each of the LED strings 300, 301, 302. Since the brightness of the LED is proportional to the current, processing, such as current balancing, may be performed to ensure that a plurality of LED strings 300, 301, 302 is driven with the constant brightness. In an LED driving circuit, the linear driver 310 may be used to maintain constant current among the channels.

Figure 3:
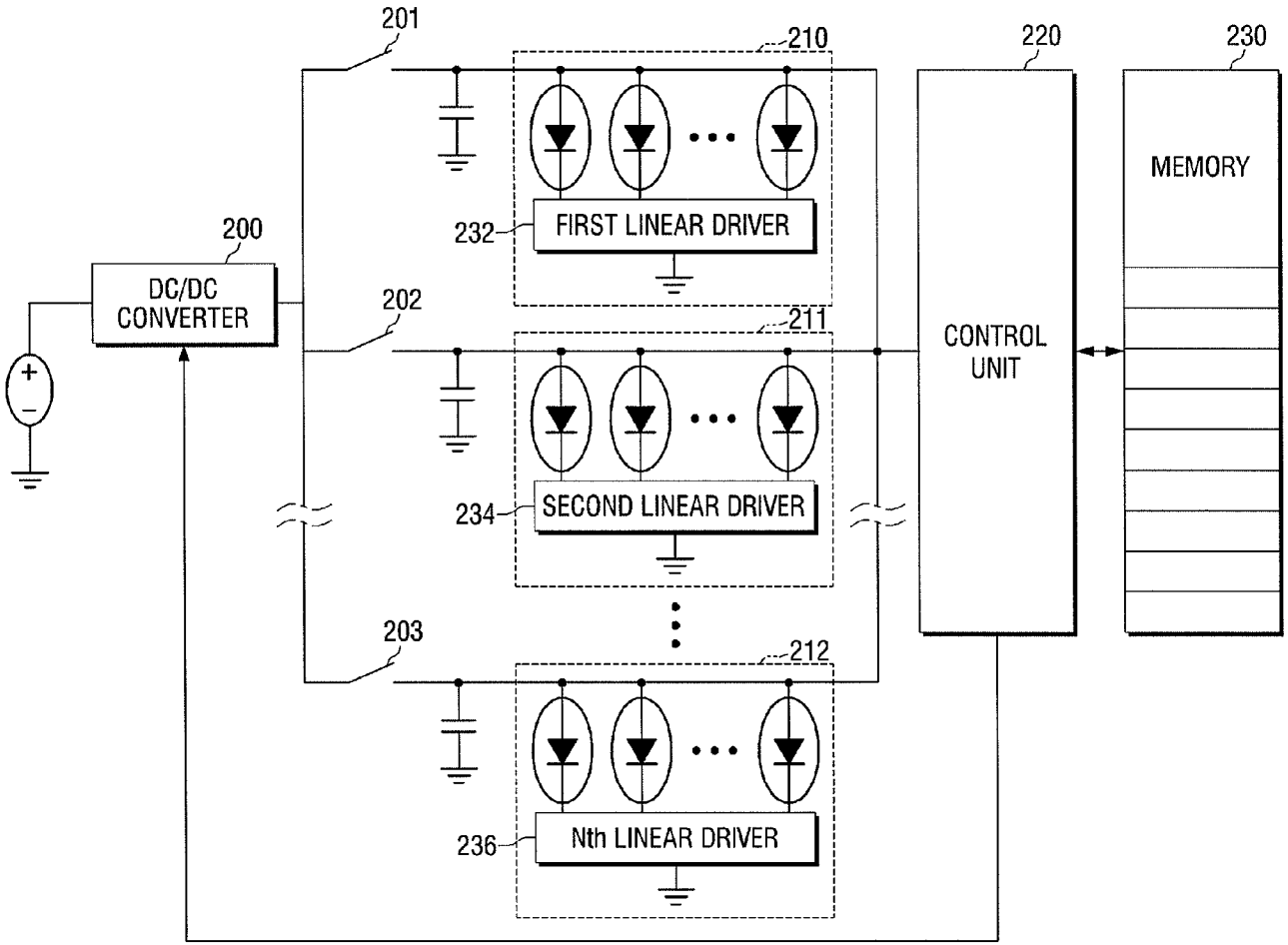
FIG. 3 is a view illustrating the structure of a BLU according to an exemplary embodiment.

FIG. 3 is a view illustrating the structure of the BLU of FIG. 2 according to an exemplary embodiment.

Referring to FIG. 3, the BLU 50 may include a DC/DC converter 200, first, second, Nth switching units 201, 202, 203, first, second, Nth light source modules 210, 211, 212, a control unit 220, and a memory 230. Each light source module 210, 211, 212 may include a corresponding first linear driver 232, second linear driver 234, Nth linear driver 236. Herein, the LED module is an example of the light source module, but this should not be construed as limiting. Accordingly, any other light source module may be used.

When the first switch 201 is turned on, the DC/DC converter 200 applies an output voltage to the first LED module 210 in accordance with a pre-stored duty ratio. Accordingly, the first LED module 210 starts operating. The first switch 201 is then turned off and the second switch 202 is turned on. Accordingly, the DC/DC converter 200 applies a voltage to the second LED module 211. The process continues for each module. The first switch 201 is turned on again after the Nth switch 203 is turned off.

While the voltage is being applied to the first LED module 210 with the first switch 201 being in an ON state, the control unit 220 determines a voltage to be applied to the first LED module 210 later when the first switch 201 is turned on next time and a first relative duty ratio, and stores the determined result in the memory 230.

An output voltage from the DC/DC converter 200 may be adjusted by adjusting the duty ratio. The voltage which is applied to the LED module is a voltage to operate each of the LED modules 210, 211, 212 in a specific state. The specific state may be the state in which each of a plurality of LED modules 210, 211, 212 outputs a constant level of brightness.

While the voltage is being applied to the second LED module 211 with the second switch 202 being in the ON state, the control unit 220 determines a voltage to be applied to the second LED module 211 later when the second switch 202 is turned on next time and a second relative duty ratio, and stores the determined result in the memory 230.

As the process continues, the control unit 220 determines the duty ratio N times while the voltage is being applied to each LED module when each of N switches is in the ON state, and stores the determined results in the memory 230.

Accordingly, if the first switch 201 is turned on again, the control unit 220 retrieves the first duty ratio from the memory 230 and controls the DC/DC converter 200 based on the first duty ratio so that a corrected voltage is applied to the first LED module 210. As a result, the first LED module 210 may be operated based on the preset brightness. The control unit 220 then determines a voltage to be applied to the first LED module 210 later when the first switch 201 is turned on next time and a first relative duty ratio, and stores the newly determined result in the memory 230, while the voltage is being applied to the first LED module 210 with the first switch 201 being in the ON state.

When the second switch 202 is turned on again, the control unit 220 retrieves the stored second duty ratio from the memory 230, and controls the DC/DC converter 200 based on the second duty ratio, and applies the corrected voltage to the second LED module 210. Therefore, the second LED module 211 may be operated based on the preset brightness. The control unit 220 determines a voltage to be applied to the second LED module 211 later when the second switch 202 is turned on next time and a second relative duty ratio, and stores the newly determined result in the memory 230, while the voltage is being applied to the second LED module 211 with the second switch 202 being in the ON state.

The above-described process continues until the Nth switch 203 is turned on. When the first switch 201 is turned on next time, the control unit 220 controls the DC/DC converter 200 based on the first duty ratio stored the latest, and provides the first LED module 210 with the corrected voltage. When the second switch 202 is turned on next time, the control unit 220 controls the DC/DC converter 200 based on the second duty ratio stored the latest, and provides the second LED module 211 with the corrected voltage. Accordingly, the LED modules 210, 211, 212 may be operated with constant brightness.

The LED modules are an example of the light source module, and it should be understood that any other light source modules, such as LED strings or light bars, or light sources such as CCFL or EL lamps may be used.

Figure 5:
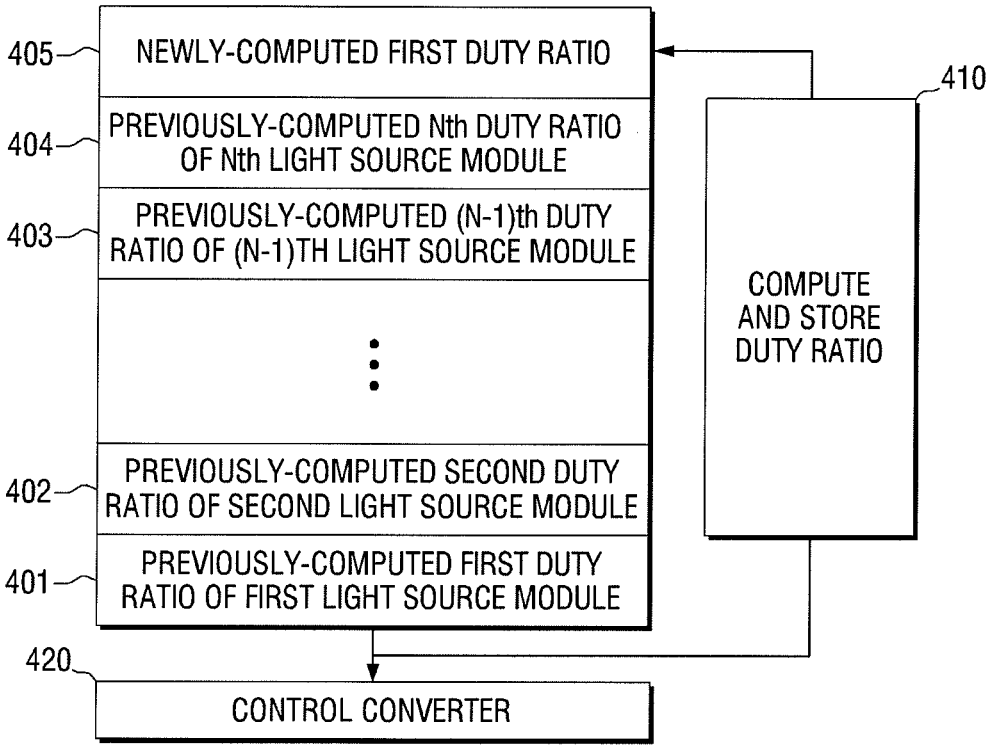
FIG. 5 is a view illustrating the operation of a memory of the BLU according to an exemplary embodiment.

The BLU according to an exemplary embodiment is described below in greater detail with reference to FIGS. 3 and 5. FIG. 5 is a view illustrating the operation of the memory of the BLU according to an exemplary embodiment.

In describing the operation of the memory according to an exemplary embodiment, a FIFO memory is used as an example. FIFO memory accepts data in sequence, and outputs the data in the same sequence. Since the first input data is called first, sequential data storage and calling is performed.

Referring to FIG. 5, the memory 230 stores the previously-determined first duty ratio 401 of the first light source module, previously-determined second duty ratio 402 of the second light source module, . . . , previously-determined (N−1)th duty ratio 403 of the (N−1)th light source module, and previously-determined Nth duty ratio 404 of the Nth light source module in sequence.

For example, the control unit 220 calls the previously-determined first duty ratio 401 of the first light source module, and controls the converter 200 based on the called first duty ratio 401 (operation 420). The first light source module 210 receives from the converter 200 a voltage which is corrected based on the previously-determined first duty ratio 401.

The control unit 220 determines a next first duty ratio to be applied to the first light source module next time, and stores the newly-determined first duty ratio 405 in the memory (operation 410). The newly-determined first duty ratio 405 is later called to the DC/DC converter 200 as the first relative duty ratio when the first light source module 210 is switched on again.

The duty ratios are determined and stored in the memory in the same manner, sequentially, regarding the rest of the light source modules, from the second light source module 211 to the Nth light source module 212. Accordingly, as the stored duty ratios are called sequentially and the converter is controlled based on the called duty ratios, a voltage may be applied to operate each of the light source modules 210, 211, 212 with the constant brightness.

The FIFO memory is an example of a memory. Those skilled in the art will understand that any type of memory, which is capable of data storing and calling, may be used.

Figure 6:
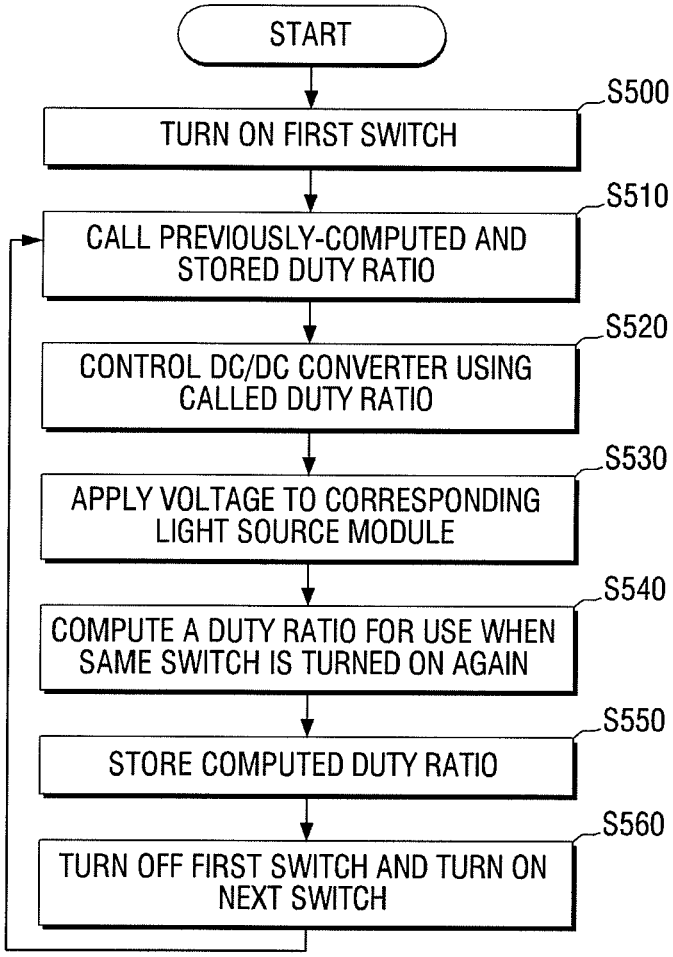
FIG. 6 is a flowchart illustrating the process of driving the BLU according to an exemplary embodiment.

The process of driving the BLU is described below in greater detail with reference to FIG. 6, which illustrates a flowchart of the process of driving the BLU according to an exemplary embodiment.

At S500, a first switch connected to the first light source module is turned on to apply a voltage to the first light source module. At S510, a previously-determined and stored duty ratio is called. At S520, the called duty ratio is applied to the DC/DC converter so that a corresponding voltage is output. At S530, the voltage, corrected by the called duty ratio, is applied to the corresponding light source module.

Next, at S540, with respect to the light source module which receives the voltage currently, a duty ratio is determined for use when the same switch is turned on again and a voltage is applied to the light source module. At S550, the determined duty ratio is stored in the memory. Next, at S560, in order to apply a voltage to the next light source module, the first switch is turned off, and a switch connected to the next light source module is turned on.

Accordingly, by determining duty ratios for a plurality of light source modules in sequence, and applying the determined duty ratios to the corresponding light source modules, voltages are applied and a plurality of light source modules is operated with the constant brightness.

Although the duty ratios are provided as an example of the powering condition of the light source modules, it is apparent that the technical concept is not limited to the examples provided above. Accordingly, those skilled in the art will understand that other types of powering conditions may be used.

According to exemplary embodiments, the powering conditions to operate a plurality of light source modules with the constant brightness are determined for each of the light source modules, and the converter is controlled sequentially based on the determined powering conditions. Accordingly, the brightness imbalance of the light source modules may be corrected, and simpler driving circuit, lower power consumption, and reduced cost may be achieved.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus comprising:

a display panel; and a backlight unit (BLU) which provides the display panel with backlight, wherein the BLU comprises:

a converter which converts a voltage of a received power and outputs an output power, a plurality of light source modules which receives the output power from the converter, wherein each of the plurality of light source modules comprises a plurality of light emitting diode strings and a linear driver configured to maintain constant current among the plurality of light emitting diode strings, a switching unit which applies the output power from the converter to one of the plurality of light source modules, and a control unit which determines powering conditions to operate the plurality of light source modules in a specific state for the each of the plurality of light source modules, and sequentially controls the output power output from the converter based on the determined powering conditions, wherein the control unit sequentially determines next powering conditions for the each of the plurality of light source modules, by determining a powering condition for a light source module which currently receives the output power through a corresponding switching unit before the light source module which currently receives the output power is switched off and a light source module next in order to receive the output power is switched on.

2. The display apparatus of claim 1, wherein the control unit controls the switching unit to apply the output power from the converter to the each of the plurality of light source modules sequentially, and controls the converter based on the powering conditions sequentially.

3. The display apparatus of claim 1, wherein the control unit senses a voltage applied to the light source module which currently receives the output power, and determines the powering conditions based on the sensed voltage.

4. The display apparatus of claim 1, wherein the BLU further comprises a memory which stores the powering conditions, and the control unit stores the determined powering conditions sequentially in the memory, and controls the converter sequentially by referring to the stored powering conditions sequentially.

5. The display apparatus of claim 4, wherein the memory comprises a first-in-first-out memory, which stores the powering conditions sequentially and refers to the stored powering conditions sequentially.

6. The display apparatus of claim 1, wherein the plurality of light source modules comprises a first light source module and a second light source module, and the control unit controls the converter according to a first powering condition which is determined for the first light source module, for a duration in which the output power from the converter is applied to the first light source module, and controls the converter according to a second powering condition which is determined for the second light source module, for the duration in which the output power from the converter is applied to the second light source module.

7. The display apparatus of claim 6, wherein the switching unit operates to apply the output power from the converter sequentially to the second light source module, after the output power is applied to the first light source module, and the control unit senses a voltage applied to the first light source module before the first light source module is switched off and the second light source module is switched on, and determines the first powering condition based on the sensed voltage.

8. The display apparatus of claim 7, wherein, when the first light source module is switched on again, the control unit controls the converter based on the first powering condition most recently determined so that the voltage corrected based on the first powering condition most recently determined is applied to the first light source module.

9. The display apparatus of claim 7, wherein, when the second light source module is switched on again, the control unit controls the converter based on the second powering condition most recently determined so that the voltage corrected based on the second powering condition most recently determined is applied to the second light source module, wherein the control unit controls the converter such that first and second powering conditions most recently determined are in a one to one correspondence for the respective first and second light source modules.

10. The display apparatus of claim 1, wherein the specific state is a state in which a constant brightness is output from the plurality of light source modules.

11. The display apparatus of claim 1, wherein the powering conditions comprise duty ratios applied to the converter to operate the plurality of light source modules in the specific state.

12. A backlight unit comprising:

a converter which converts a voltage of an input power and outputs an output power;

a plurality of light source modules which receives the output power from the converter, wherein each of the plurality of light source modules comprises a plurality of light emitting diode strings and a linear driver configured to maintain constant current among the plurality of light emitting diode strings;

a switching unit which applies the output power from the converter to one of the plurality of light source modules; and a control unit which determines powering conditions to operate the plurality of light source modules in a specific state, for the each of the light source modules, and sequentially controls the output power output from the converter in accordance with the determined powering conditions, wherein the control unit sequentially determines next powering conditions for the each of the plurality of light source modules, by determining a powering condition for a light source module which currently receives the output power through a corresponding switching unit before the light source module which currently receives the output power is switched off and a light source module next in order to receive the output power is switched on.

13. The backlight unit of claim 12, wherein the control unit controls the switching unit to apply the output power from the converter to the plurality of light source modules sequentially, and controls the converter based on the powering conditions sequentially.

14. The backlight unit of claim 12, wherein the control unit senses a voltage applied to the light source module which currently receives the output power, and determines the powering conditions based on the sensed voltage.

15. The backlight unit of claim 12, further comprising a memory which stores the powering conditions, and the control unit stores the determined powering conditions sequentially in the memory, and controls the converter sequentially by referring to the stored powering conditions sequentially.

16. The backlight unit of claim 12, wherein the plurality of light source modules comprises a first light source module and a second light source module, and the control unit controls the converter according to a first powering condition which is determined for the first light source module, for a duration in which the output power from the converter is applied to the first light source module, and controls the converter according to a second powering condition which is determined for the second light source module, for the duration in which the output power from the converter is applied to the second light source module.

17. The backlight unit of claim 16, wherein the switching unit which operates to apply the output power from the converter sequentially to the second light source module, after the output power is applied to the first light source module, and the control unit senses a voltage applied to the first light source module before the first light source module is switched off and the second light source module is switched on, and determines the first powering condition based on the sensed voltage.

18. The backlight unit of claim 17, wherein, when the first light source module is switched on again, the control unit controls the converter based on the first powering condition most recently determined so that the voltage corrected based on the first powering condition most recently determined is applied to the first light source module.

19. The backlight unit of claim 12, wherein the specific state is a state in which a constant brightness is output from the plurality of light source modules.

20. A backlight unit comprising:

a converter which adjusts and provides voltage;

first and second switches, coupled to the converter, which are turned on and off in sequence;

a control unit which determines first and second next powering conditions, in sequence, when the first switch is turned on or the second switch is turned on, respectively, in sequence, by determining a powering condition for a light source module which currently receives an output power through a corresponding switches before the light source module which currently receives the output power is switched off and a light source module next in order to receive the output power is switched on; and first and second light source modules, which are coupled to the first and second switches, respectively, and, when the first switch or the second switch is again turned on, receive, in sequence, a first voltage and a second voltage adjusted by the converter based on the determined first and second powering conditions, respectively, wherein each of the first and second light source modules comprises a plurality of light emitting diode strings and a linear driver configured to maintain constant current among the plurality of light emitting diode strings.

21. The backlight unit of claim 20, wherein the control unit senses the first voltage or the second voltage currently being applied to the respective first source module or second light source module, being connected to the converter by the first switch or the second switch, respectively, determines new first and second powering conditions based on the sensed first voltage and second voltage, and stores the new first and second powering conditions, in sequence.

22. The backlight unit of claim 21, wherein the converter adjusts the first voltage and the second voltage, based on the new first and second powering conditions, respectively, and applies the adjusted first voltage or the adjusted second voltage to the respective first and second light source modules, in sequence.

* * * * *